US012098046B1

(12) United States Patent
Waible

(10) Patent No.: US 12,098,046 B1
(45) Date of Patent: Sep. 24, 2024

(54) PORTABLE TAPE DISPENSER

(71) Applicant: Stephen Roy Waible, Ridgefield, WA (US)

(72) Inventor: Stephen Roy Waible, Ridgefield, WA (US)

( * ) Notice: Subject to any disclaimer, the term of this patent is extended or adjusted under 35 U.S.C. 154(b) by 0 days.

(21) Appl. No.: 18/435,631

(22) Filed: Feb. 7, 2024

Related U.S. Application Data

(60) Provisional application No. 63/483,918, filed on Feb. 8, 2023.

(51) Int. Cl.
*B65H 35/00* (2006.01)
*B65H 75/22* (2006.01)

(52) U.S. Cl.
CPC ..... *B65H 35/002* (2013.01); *B65H 75/2272* (2021.05); *B65H 2701/377* (2013.01)

(58) Field of Classification Search
CPC .... B65H 75/14; B65H 75/22; B65H 75/2245; B65H 75/2254; B65H 75/2272; B65H 35/002; B65H 2701/1377; B65H 2701/5136; B65H 49/205
USPC ..... 242/588.1
See application file for complete search history.

(56) References Cited

U.S. PATENT DOCUMENTS 1,271,308 A * 7/1918 Green ..... B65H 75/14 242/118.6
1,901,737 A * 3/1933 Dunlap ..... B65H 75/14 242/118.61
2,837,297 A * 6/1958 Moss ..... D06B 23/042 242/118.62
3,921,936 A 11/1975 Suter
4,195,794 A 4/1980 Ricci et al.
4,919,359 A * 4/1990 Powel ..... B65H 75/28 242/125.1
5,868,348 A * 2/1999 Bulman ..... B65H 75/2245 242/608.5
6,182,921 B1 * 2/2001 Muylle ..... B65H 75/185 242/608.5
6,609,671 B2 * 8/2003 Heesch ..... A01K 89/0111 242/586
6,676,069 B1 * 1/2004 Davis ..... B65H 75/146 242/608.5
7,201,201 B2 4/2007 Grenier
8,845,850 B2 * 9/2014 Kostick ..... B32B 7/12 156/331.7
9,873,582 B2 1/2018 Stenavich
10,435,268 B2 10/2019 Briggs et al.
(Continued)

OTHER PUBLICATIONS

Excell, Professional Tape Dispenser Manufacturer, ET-12281, Extra Wide Bench Tape Dispensers, https://www.excell.co/et-12281-extra-wide-bench-tape-dispenser.html, first viewed Dec. 2022.
(Continued)

*Primary Examiner* — William A. Rivera
(74) *Attorney, Agent, or Firm* — Klarquist Sparkman, LLP

(57) ABSTRACT

A portable tape dispenser is disclosed. The portable tape dispenser can comprise a spool and two sidewalls which overhang the spool to capture a roll of tape on the spool. In some examples, one of the sidewalls can have a clip for attaching the portable tape dispenser to a user's clothing. In some examples, the tape dispenser can have features such as a through hole disposed in one of the sidewalls or an extension piece to adjust the width of the spool.

16 Claims, 9 Drawing Sheets

(56) References Cited

U.S. PATENT DOCUMENTS

| | | | | |
|---|---|---|---|---|
| 2004/0149798 | A1 | 8/2004 | Hoffman et al. | |
| 2007/0257146 | A1* | 11/2007 | Fleming | B65H 75/28 242/396 |
| 2007/0267148 | A1 | 11/2007 | Steele et al. | |
| 2009/0008494 | A1* | 1/2009 | Maley | B65H 75/28 242/608.5 |
| 2009/0230164 | A1 | 9/2009 | Freeman | |
| 2016/0221788 | A1 | 8/2016 | Foreman | |
| 2019/0337746 | A1* | 11/2019 | Briggs | B65H 49/327 |

OTHER PUBLICATIONS https://www.thetapetoolcompany.com/ Similar to U.S. Pat. No. 9,873,582, website still active, first viewed Dec. 2022.

https://collisionedge.com/product-category/the-tape-thing/ Similar to U.S. Pat. No. 10,435,268, website still active, first viewed Dec. 2022.

* cited by examiner

PORTABLE TAPE DISPENSER

CROSS-REFERENCE TO RELATED APPLICATIONS

This application claims the benefit of U.S. Provisional Application No. 63/483,918, filed Feb. 8, 2023, which is incorporated by reference.

FIELD

This disclosure relates to portable tape dispensers (also referred to as "tape holders"). Particularly to tape holders used for adhesive tape.

BACKGROUND

Many industries, such as construction and automotive repair, use tape for different applications in the workplace. Tape can come on rolls with a variety of widths and these rolls can be easily misplaced or dropped causing inconvenience to the user.

Tape rolls may also need to be secured to the user or to a surface in the workspace. The portable tape dispenser should also allow easy, possibly even one handed, access to the tape and tape dispensing.

As such, a portable tape dispenser which securely captures the tape roll and/or is adjustable to fit different roll widths is needed. Also, there is a need for improved devices which secure a tape roll to the user or a surface and allow easy access to, and dispensing of, the tape.

SUMMARY

Described herein are portable tape holders. The disclosed portable tape holders can, for example, provide improved capture of a tape roll, an adjustable width for tape rolls of different widths, capture devices for attaching the tape holder to a user's clothing, and magnets. As such, the tape holders disclosed herein can, among other things, overcome one or more of the deficiencies of typical tape holders.

In some examples, a tape holder comprises: a pair of sidewalls comprising a first sidewall and a second sidewall; a spool with a first end and a second end, wherein the first end is fixedly coupled to the first sidewall and the second end has internal threads; and a connector wherein the connector has external threads and is fixedly coupled to the second sidewall wherein the external threads of the connector are sized and shaped to couple with the internal threads of the second end of the spool.

In some examples, the first sidewall and the second sidewall are polygonal. In some examples, the first sidewall and the second sidewall are hexagonal.

In some examples, the tape holder comprises a clip coupled to one of the sidewalls of the pair of sidewalls. In some examples, the clip is coupled to the second sidewall and the second sidewall comprises a projection which houses the clip. In some examples, the projection comprises a ramp. In some examples, the projection further comprises two side extensions, wherein the ramp and the two side extensions at least partially surround a recessed portion.

In some examples, the tape holder comprises a through hole in at least one of the sidewalls of the pair of sidewalls.

In some examples, the tape holder comprises an extension piece, wherein the spool has a spool diameter and the extension piece has an extension piece diameter and the spool diameter and the extension piece diameter are equal, and the extension piece has a first end and a second end, wherein the first end of the extension piece has external threads and the second end of the extension piece has internal threads, and wherein the external threads of the first end of the extension piece are formed so as to couple with the internal threads of the second end of the spool, and wherein the internal threads of the second end of the extension piece are formed so as to couple with the external threads of the connector.

In some examples, the tape holder comprises one or more magnets embedded in one of the sidewalls of the pair of sidewalls.

In some examples, the spool further comprises projections spaced out around an outer surface of the spool.

In some examples, a tape holder comprises: a first sidewall; a second sidewall; and a spool comprising a spool first portion and a spool second portion, wherein the spool first portion is coupled to the first sidewall and the spool second portion is coupled to the second sidewall. herein the spool first portion is removably coupled to the spool second portion. In some examples, the spool first portion is threadedly coupled to the spool second portion.

The various innovations of this disclosure can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the disclosure will become more apparent from the following detailed description, claims, and accompanying figures.

DETAILED DESCRIPTION

General Considerations

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially (e.g., assembly or disassembly of an apparatus) may in some cases be rearranged or performed concurrently. Moreover, for the sake of simplicity, the attached figures may not show the various ways in which the disclosed methods can be used in conjunction with other methods. As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C," or "A, B, and C."

As used herein, the term "coupled" generally means physically coupled or linked. Two components that are coupled to each other can be directly connected to each other or can be indirectly connected to each other with one or more intermediate elements between the coupled items.

As used herein, the term "integrally formed" generally means formed as a unitary structure. Two of more components can be integrally formed, for example, by machining the components as a unitary structure from a single piece of material. Two of more components can be integrally formed, for example, by welding two components together to form a unitary structure.

Exemplary Embodiments

FIGS. 1-11 depict a portable tape dispenser (also referred to as a "tape holder") 100, according to one example where portable means that a single user can easily carry or move the apparatus with one hand.

Figure 1:
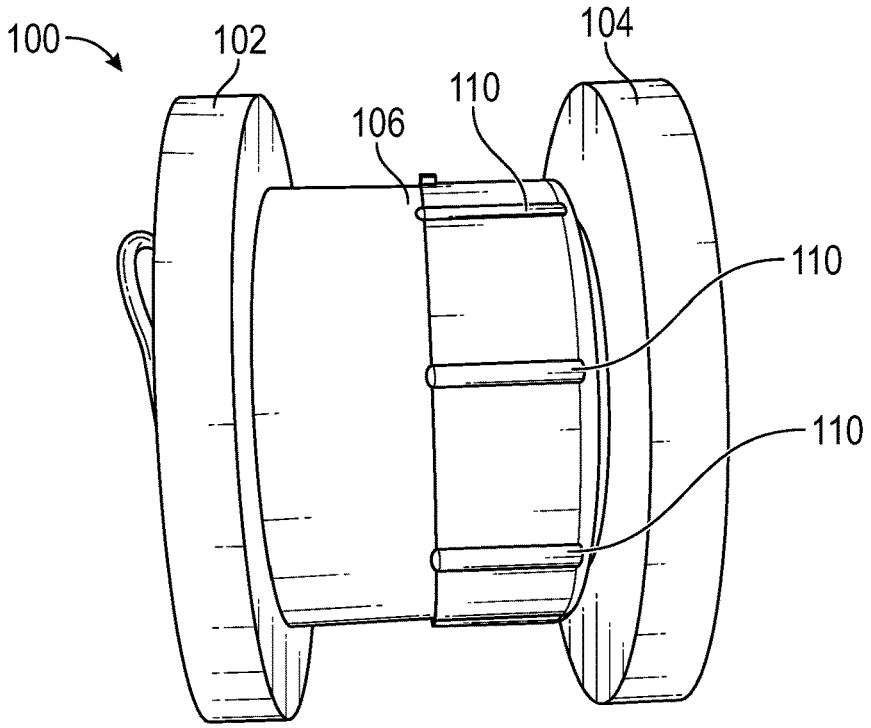
FIG. 1 is a perspective view of a portable tape dispenser, according to one example.

As shown in FIG. 1, the portable tape dispenser 100 comprises a first sidewall 102, a second sidewall 104, and a spool 106. The first sidewall 102 and second sidewall 104 may be referred to together as a "pair of sidewalls." The first sidewall 102 and second sidewall 104 can be interchangeable and any features described herein with regards to the first sidewall 102 can be applied to the second sidewall 104, and vice versa. The first and second sidewalls 102, 104 overhang the spool 106 and form rims which are designed to securely capture a tape roll on the spool 106 and prevent the tape roll from falling off the spool 106. In the depicted example, the sidewalls are circular. In some examples, the sidewalls can be any suitable shape, for example hexagonal, octagonal, or another polygon. In some examples, the sidewalls can be substantially circular with one or more flat edges to prevent the portable tape dispenser from rolling when placed on a surface. In some examples, the sidewalls are constructed of a rigid material. In some examples, the sidewalls are constructed of wood. In some examples, the sidewalls comprise plastic. Various other materials can be used including polymeric materials, metals, or a mixture of different materials.

The sidewalls 102, 104 may be solid or may have one or more apertures. In some examples, these apertures may be arranged around the rim of the sidewall to reduce the overall weight of the tape holder while maintaining structural integrity. In some examples, one or both of the sidewalls may have a bore or through hole 108 in the center of the sidewall. This hole allows the user to insert a finger into the spool 106 while it is being held in the user's hand, thereby allowing the user to have a better hold on the portable tape dispenser and allowing the tape to be dispensed with greater ease.

Referring again to FIG. 1, the spool 106 is sized to fit within a tape roll. In some examples, the outer diameter of the spool 106 is smaller than the inner diameter of the tape roll, leaving clearance between the tape roll and the spool 106 and allowing the tape roll to freely spin around the spool 106 as the tape is dispensed. In some examples, the spool 106 is sized to fit with a tight tolerance with the tape roll. In some such instances, friction between the inner surface of the tape roll and the outer surface of the spool 106 may prevent the tape roll from spinning freely around the spool 106.

In the depicted example, the spool 106 is cylindrical. In some examples, the cross section of the spool 106 may be of a different shape such as hexagonal, octagonal, or another polygon. In some examples, the spool 106 is constructed of a rigid material. In one example the spool 106 is made of plastic such as polyvinyl chloride (PVC). Acrylonitrile butadiene styrene (ABS) is also a suitable polymeric material. Various other materials can be used including polymeric materials, metals, or a mixture of different materials.

In some examples, the spool 106 may have projections on its exterior surface to facilitate better fitting with the inner surface of the tape roll. These projections may extend along the entire length of the spool 106 or a portion thereof. In the depicted example, as seen in FIG. 1, these projections 110 are a series of raised lines which extend parallel to the longitudinal axis of the spool 106 and are evenly spaced around the outer surface of the spool 106. In some instances, the projections can be omitted, and the spool 106 can have a relatively smooth outer surface for receiving the tape roll.

Figure 5:
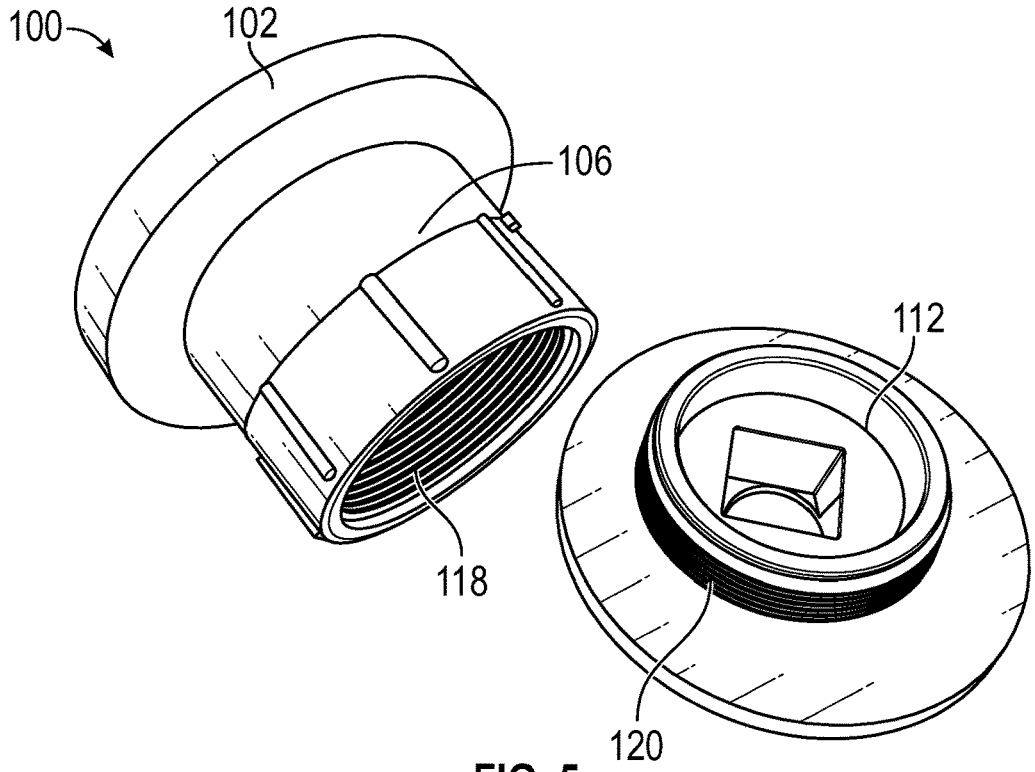
FIG. 5 is a perspective view of the portable tape dispenser of FIG. 1, depicting the connector separated from the spool portion.

Referring to FIG. 5, the first sidewall 102 is fixedly coupled to the first end of the spool 106, such as by adhesive, fasteners, etc. In some examples the first sidewall 102 may be integrally formed with the spool 106 so that the first sidewall 102 and the spool 106 are constructed as a single, unitary component. The second sidewall 104 is removably coupled to the second end of the spool 106 by means of a connector 112. This removable second sidewall 104 allows the tape roll to be installed on the spool 106. Once the tape roll is installed and the second sidewall 104 is attached to the spool 106, the two sidewalls prevent the tape roll from falling off the spool 106.

The second sidewall 104 is fixedly coupled to a connector 112. This connection can be made by a square projection 114 of the connector 112 which fits into a square hole 116 of the same size in the second sidewall 104 (see, e.g., FIG. 3). In the example shown, the projection extends through the second sidewall 104. In some examples, the projection may be flush with the exterior surface of the second sidewall 104. In some examples, the connector 112 is constructed of a rigid material. In one example the connector 112 is made of plastic such as PVC. Various other materials can be used including polymeric materials, metals, or a mixture of different materials. In some examples, the second sidewall 104 and the connector 112 may be integrally formed so that the second sidewall 104 and the connector 112 are constructed as a single, unitary component.

In one example, the second end of the spool 106 has internal threads (female end) 118, and the connector 112 has external threads (male end) 120. The external threads of the connector 112 and internal threads 118 of the second end of the spool 106 are formed to fit together. One advantage of this threaded connection is that it forms a secure connection between the second sidewall 104 and the spool 106 which ensures the tape roll is securely captured by the tape holder. In another example, it is possible for the second end of the spool 106 to have external threads (male end) and the connector 112 to have matching internal threads (female end). Various other techniques can be used to attach the second sidewall 104 to the second end of the spool 106, these techniques include the use of one or more magnets, bolts, screws, frictional fit (e.g., snap fit), and/or other suitable means.

Figure 2:
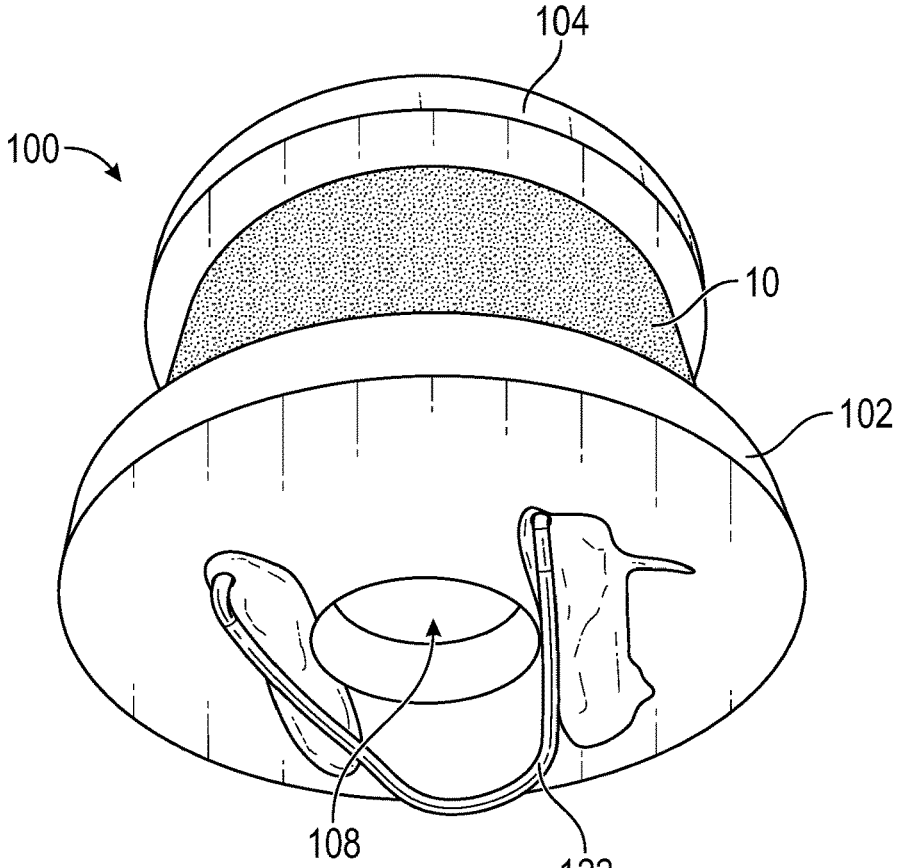
FIG. 2 is a perspective view of a first side view of the portable tape dispenser of FIG. 1 with a roll of tape secured thereon.

Referring to FIG. 2, one of the sidewalls may also have a mechanism for attaching the portable tape dispenser to the user. One advantage of such a mechanism is to easily secure the portable tape dispenser to the user to help ensure the tape holder is not dropped or lost. In one example, this mechanism may be a clip for attaching the portable tape dispenser to a piece of the user's clothing. In one instance, this mechanism is a clip 122 which can, for example, hook over a user's belt or other piece of the user's clothing. In some examples, this mechanism may be a loop, clip, or hook. In some examples, as shown in FIG. 2, the clip 122 is made of a single metal wire bent into a "U" shape with the ends attached to one of the sidewalls. In some examples, the belt clip may be a flat piece of metal bent over on itself, such as a holster clip. In some examples, the mechanism may be constructed of other materials such as plastic.

Figure 3:
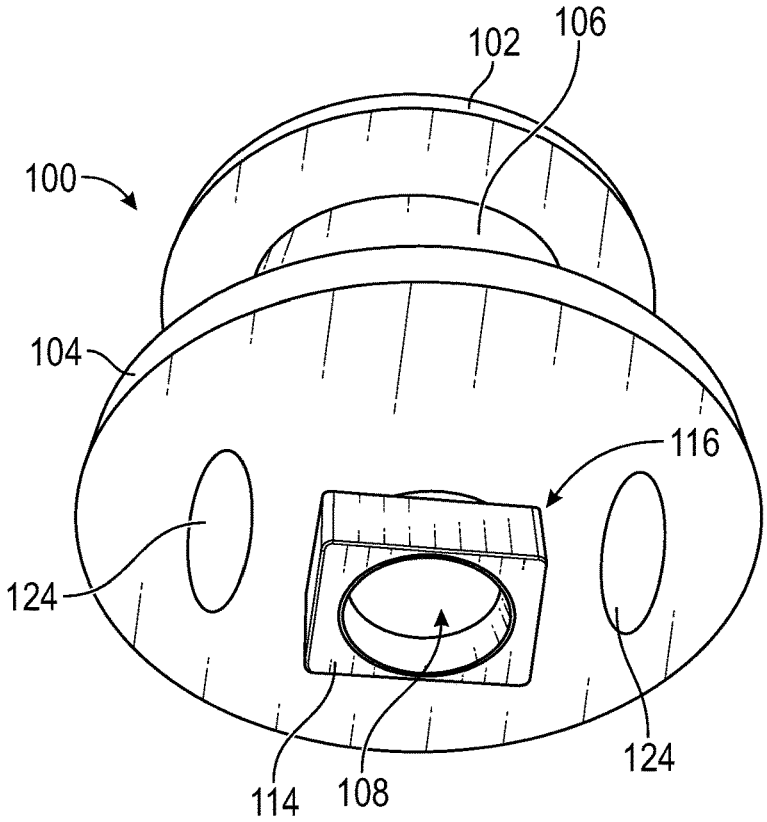
FIG. 3 is a perspective view a second side view of the portable tape dispenser of FIG. 1.
Figure 4:
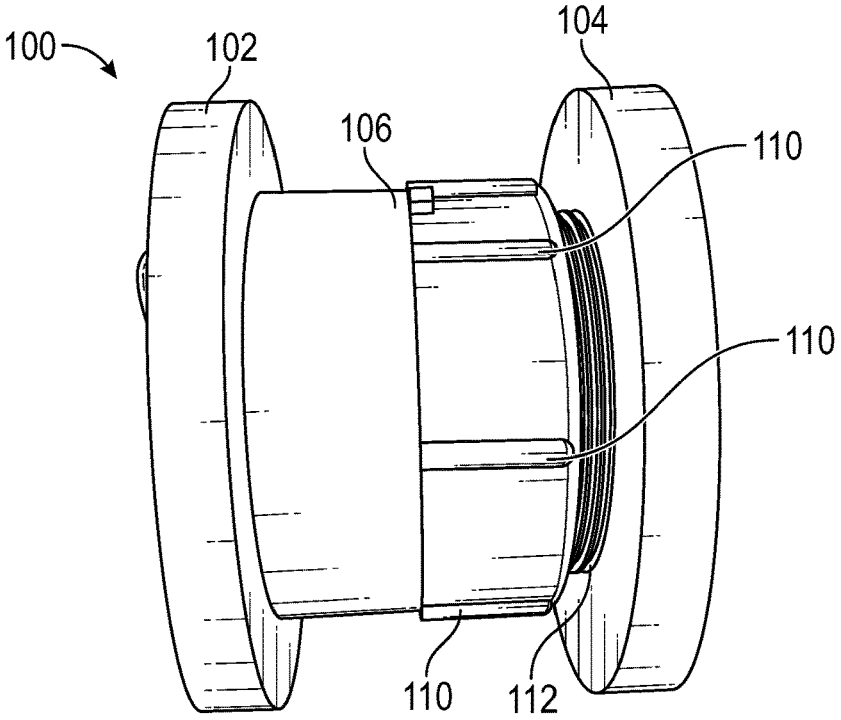
FIG. 4 is a perspective view of the portable tape dispenser of FIG. 1, depicting the connector partially unscrewed from the spool portion.

Referring to FIG. 3, one of the sidewalls may also have one or more magnets embedded therein. The advantage of the embedded magnets is to allow the portable tape dispenser to be affixed to ferromagnetic surfaces in the workspace. In some examples, the magnets are embedded in the outer surface of the sidewall and may be flush with the outer surface. In the depicted example, there are two oval magnets 124 embedded in the second sidewall 104. In some examples, the size, shape, location, and number of magnets may vary.

In a workspace, there may be a need for tape rolls with different widths. In some examples there may also be a mechanism for changing the length of the spool 106. A portable tape dispenser with a spool 106 which can be extended to accept different tape rolls has the advantage of allowing the user to own a single portable tape dispenser which can be adjusted to accept different rolls of tape with different widths.

Figure 6:
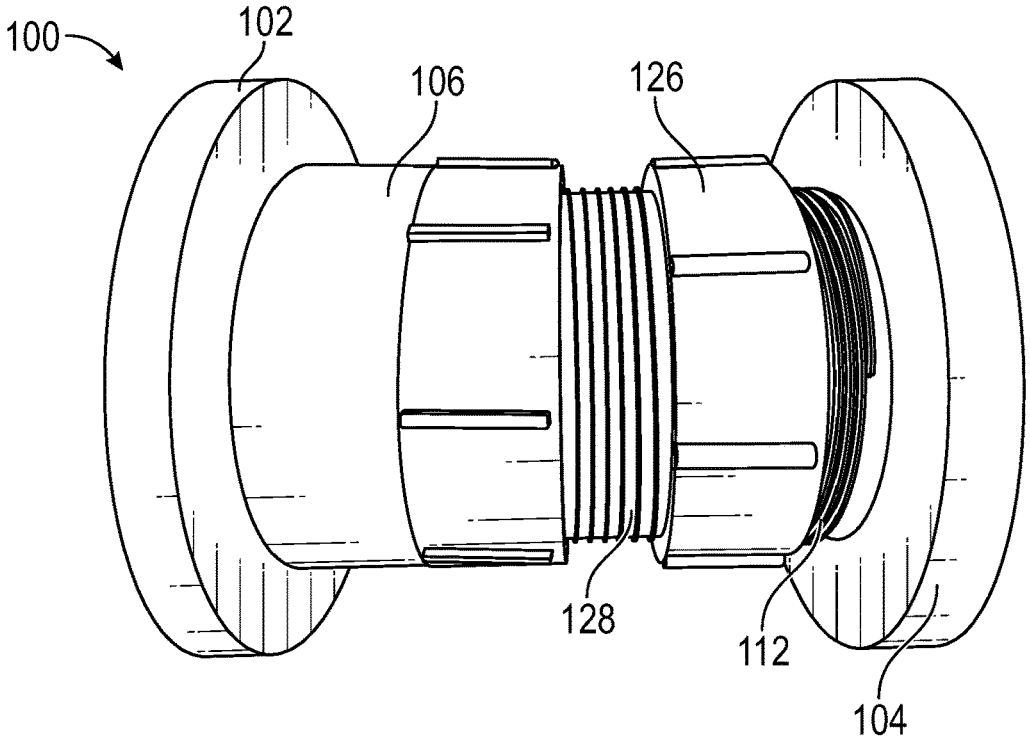
FIG. 6 is a perspective view of the portable tape dispenser of FIG. 1 with an additional extension piece partially inserted.
Figure 7:
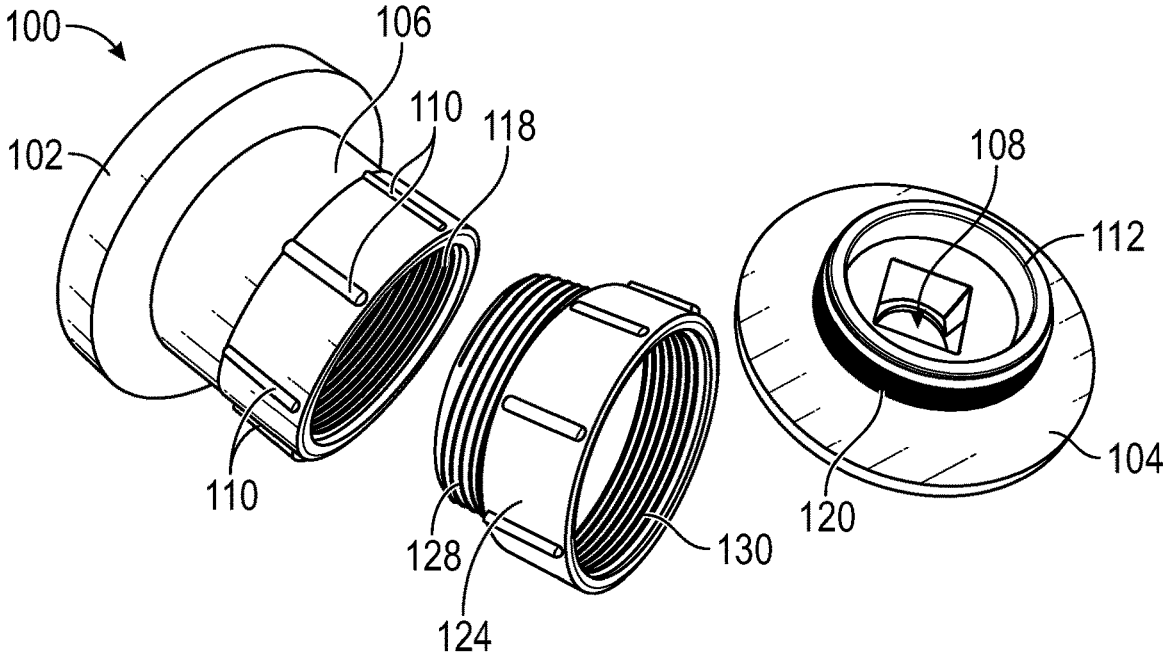
FIG. 7 is a perspective view of the portable tape dispenser of FIG. 6, depicting the connector separated from extension piece and the extension piece separated from the spool portion.
Figure 8:
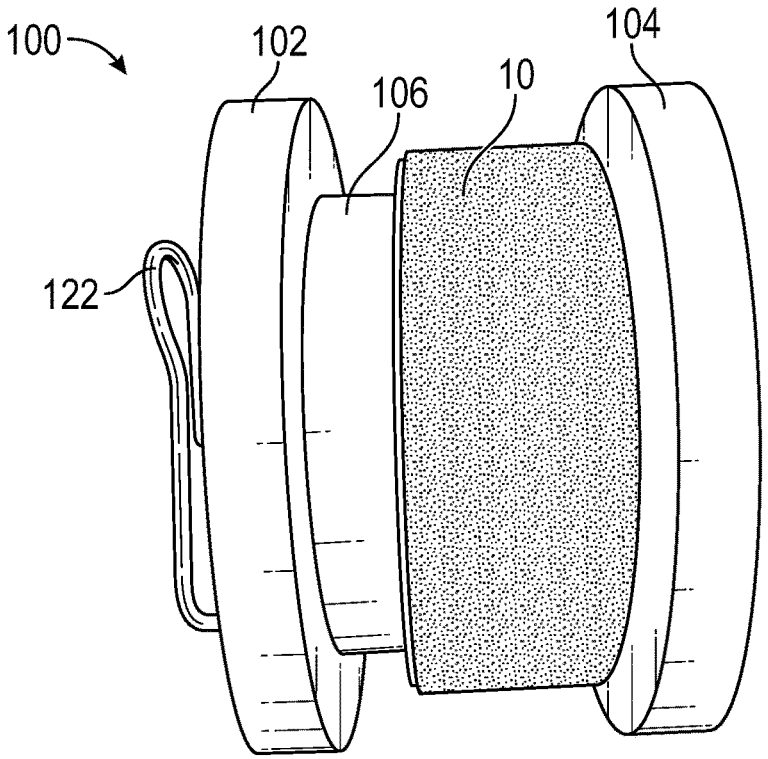
FIG. 8 is a perspective view of the portable tape dispenser of FIG. 1 with a roll of tape secured thereon.
Figure 9:
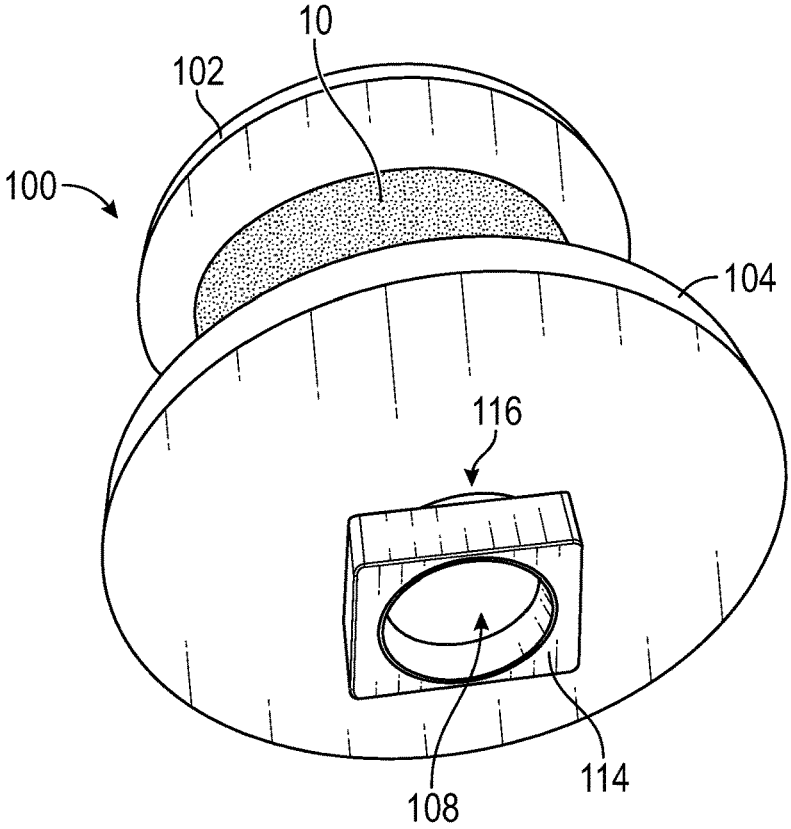
FIG. 9 is a perspective view of a second side view of the portable tape dispenser of FIG. 1 with a roll of tape secured thereon.
Figure 10:
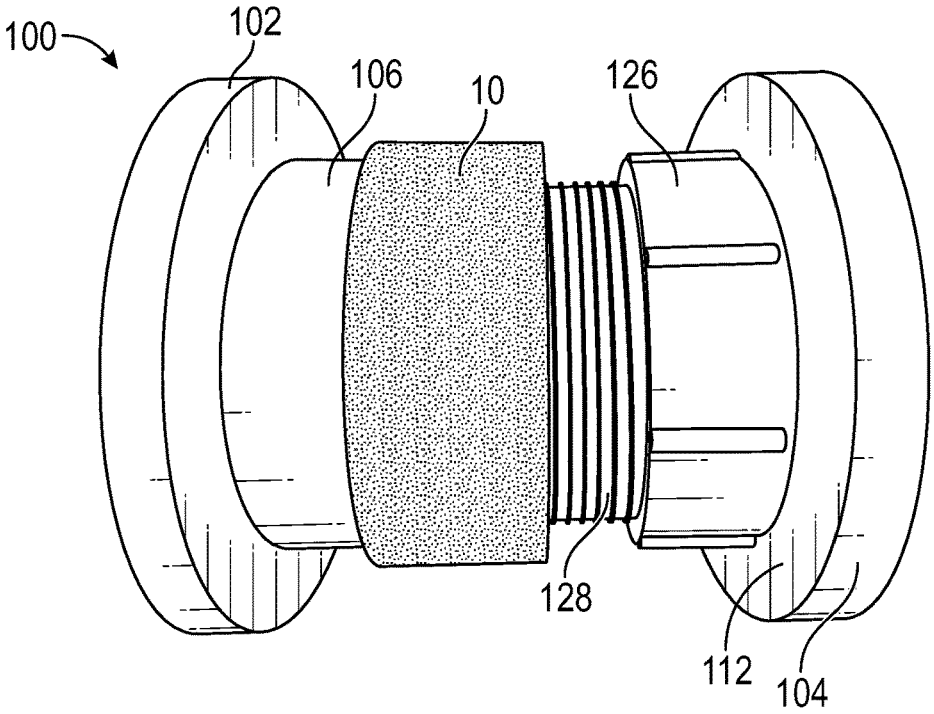
FIG. 10 is a perspective view of the portable tape dispenser of FIG. 6 with an extension piece partially inserted, with a roll of tape secured thereon.
Figure 11:
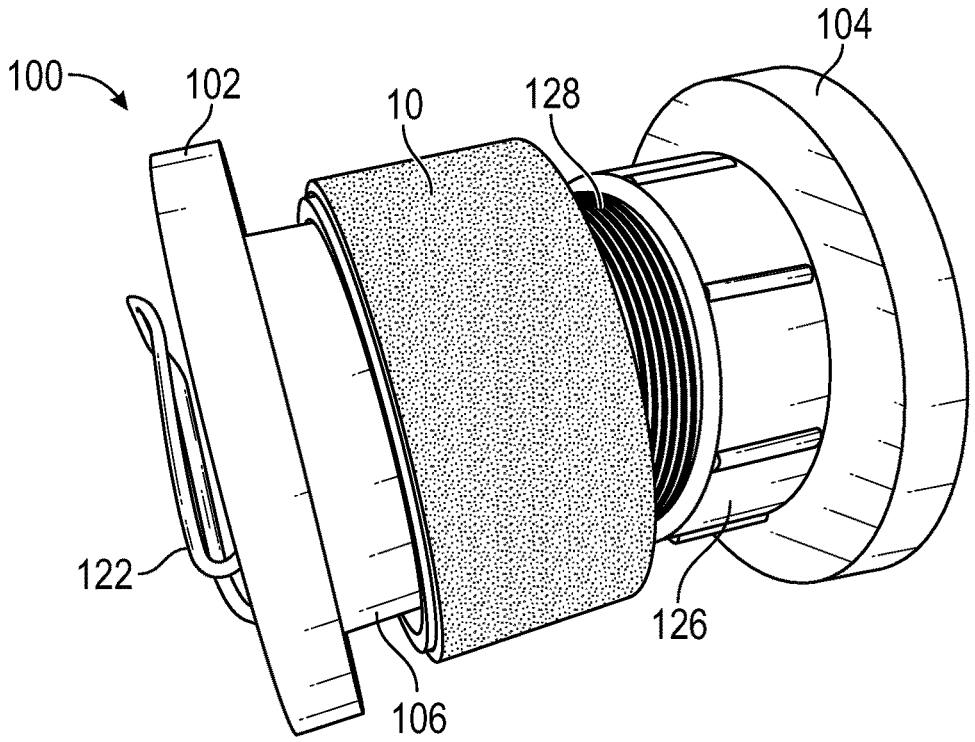
FIG. 11 is a perspective view of the portable tape dispenser of FIG. 6 with an extension piece partially inserted, depicting the belt clip, and with a roll of tape secured thereon.

Referring to FIGS. 6-7, in some examples the mechanism for extending the length of the spool 106 may be a removable extension piece 126. The extension piece 126 is of the same diameter as the spool 106 diameter and has a first and second end. That is, in some examples, the extension piece diameter and the spool diameter are equal. The first end of the extension piece 126 is formed to fit with the second end of the spool 106 and the second end of the extension piece is formed to fit with the connector 112. In one example, the first end 128 of the extension piece 126 has external threads which are formed to fit in the internal threads 118 of the second end of the spool 106 and the second end 130 of the extension piece 126 has internal threads which are formed to accept the external threads 120 of the connector 112.

In some examples, a coupling element can be positioned between the second sidewall 104 and the spool 106. The coupling element acts as a bushing or spacer that separates the second sidewall 104 from the spool 106 when the connector 112 is fully inserted into the spool 106. In some examples, the coupling element can be an O-ring, washer, etc. The coupling element can, for example, reduce the likelihood of the second sidewall 104 binding (e.g., due to overtightening) relative to the spool 106, which can make it easier to uncouple the second sidewall 104 from the spool 106 when desired. The coupling element can, for example, also help reduce the likelihood that the second sidewall 104 is inadvertently loosened relative to the spool by providing pressure (e.g., a tensile force) against the threads of the second sidewall and the spool due to the resiliency of the coupling element, which can be formed from an elastomeric material (e.g., a rubber O-ring) and/or a metallic material (e.g., a wavy washer or a compression spring). Additionally, or alternatively, a coupling element can be disposed between the removable extension piece 126 and the spool 106 and/or between the removable extension piece 126 and the second side wall 104.

FIGS. 8-11 depict additional views of the portable tape dispenser 100. These views include additional depictions of components such as the first sidewall 102, second sidewall 104, spool 106, through hole 108, clip 122, etc. These components are described in detail above with respect to other figures.

Figure 12:
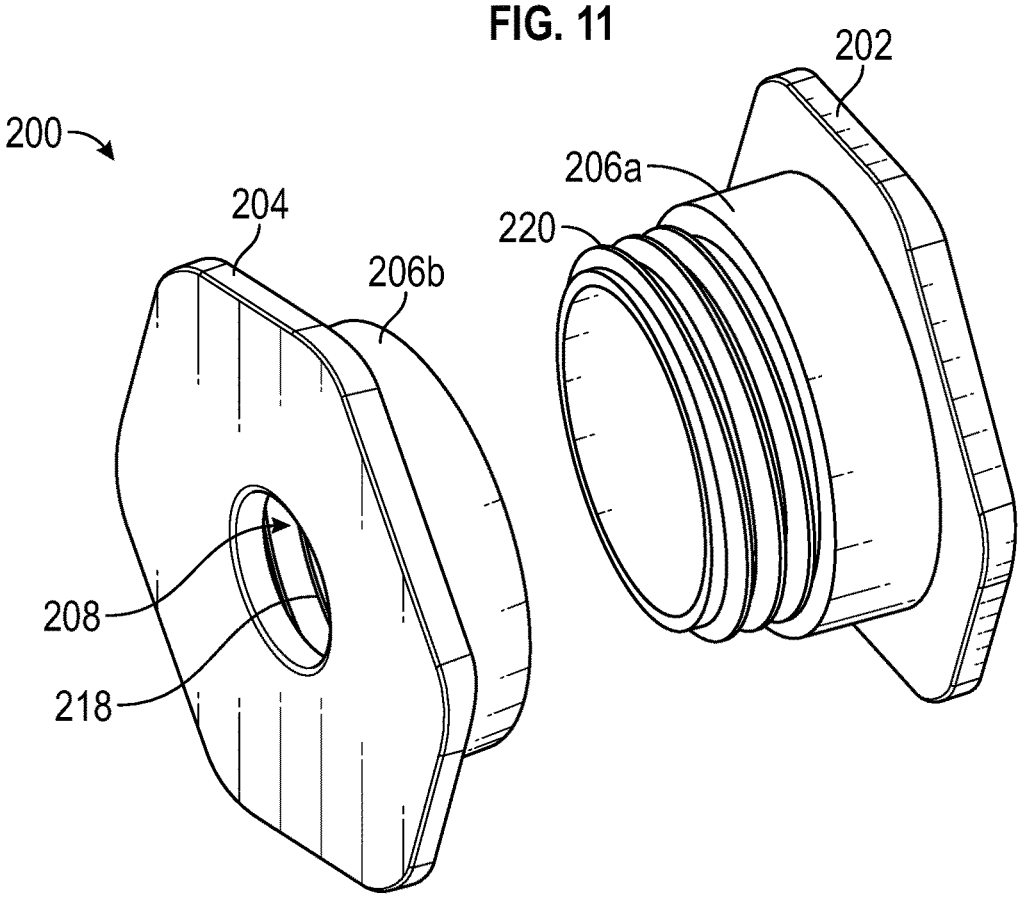
FIG. 12 is an exploded view of a portable tape dispenser according to another example.
Figure 13:
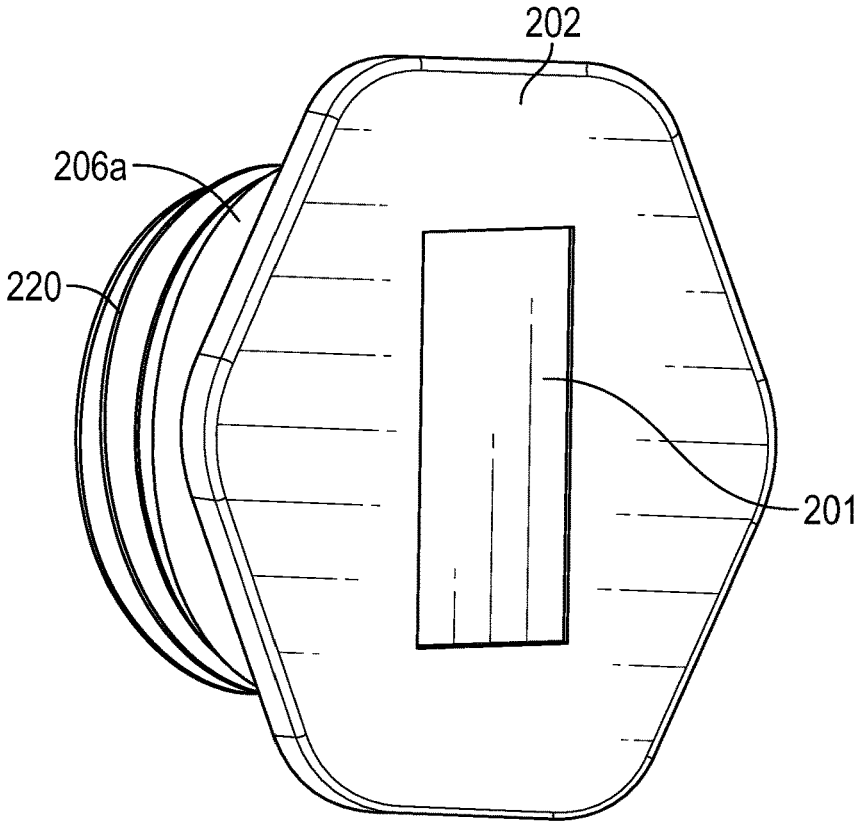
FIG. 13 is a perspective view of one end of the portable tape dispenser of FIG. 12 depicting a recessed portion.
Figure 14:
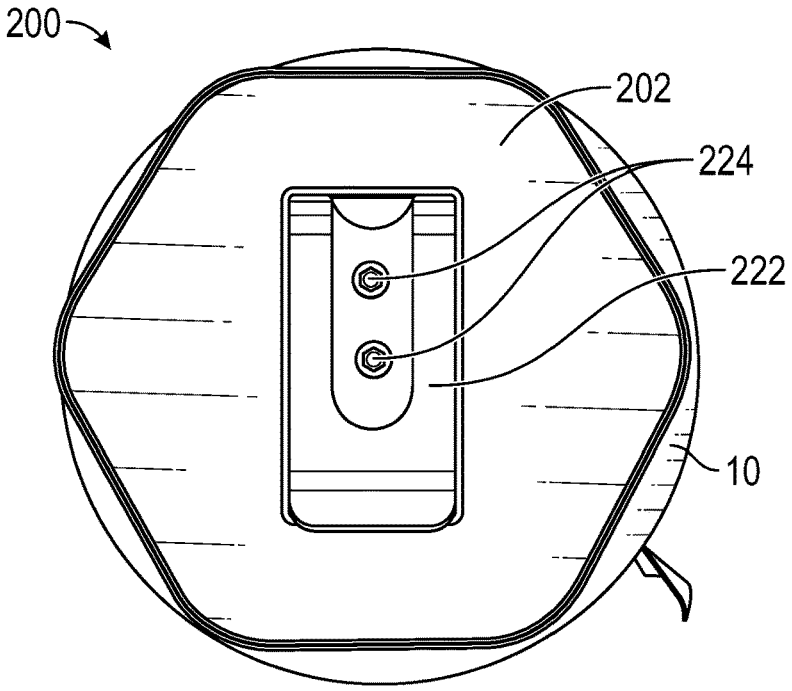
FIG. 14 is a side elevation view of the end of the portable tape dispenser of FIG. 12 depicting a clip.

FIGS. 12-14 depict a portable tape dispenser (also referred to as a "tape holder") 200 according to another example. As shown in FIG. 12, the portable tape dispenser 200 comprises a first sidewall 202, a second sidewall 204, and a spool. The first sidewall 202 and second sidewall 204 may be referred to together as a "pair of sidewalls." The first sidewall 202 and second sidewall 204 can be interchangeable and any features described herein with regards to the first sidewall 202 can be applied to the second sidewall 204, and vice versa. The sidewalls 202, 204 overhang the spool and form rims which are designed to securely capture a tape roll 10 on the spool and prevent it from falling off the spool. In the depicted example, the spool comprises two portions, a first spool portion 206*a* and a second spool portion 206*b*. The first spool portion 206*a* is coupled to the first sidewall 202 and the second spool portion 206*b* is coupled to the second sidewall 204. In some examples, the first sidewall 202 and the first spool portion 206*b* are integrally formed from one continuous piece of material. In some examples, the second sidewall 204 and the second spool portion 206*b* are integrally formed from one continuous piece of material. In some examples, the spool portions 206*a*, 206*b* may be coupled with the respective sidewall 202, 204 by a permanent or semi-permanent connection, such as by glue, bolts, screws, pins or by other similar means.

The first and second spool portions 206*a*, 206*b* are sized and shaped to fit within a tape roll 10 (FIG. 14). In some examples the outer diameters of the first and second spool portions 206*a*, 206*b* are smaller than the inner diameter of the tape roll 10, leaving clearance between the inner diameter of the tape roll 10 and the spool and allowing the tape roll 10 to freely spin around the spool as the tape is dispensed. In some examples, the first and second spool portions 206*a*, 206*b* are sized to fit with a tight tolerance with the tape roll 10. In some such examples, friction between the inner surface of the tape roll 10 and the outer surface of the spool may prevent the tape roll 10 from spinning freely around the spool. In some examples, the first and/or second spool portions 206*a*, 206*b* may have projections, similar to projections 110 as described above.

As mentioned above, in the depicted example the spool comprises a first spool portion 206*a* and a second spool portion 206*b*. In FIG. 12, the first spool portion 206*a* comprises a section with external threads 220 and the second spool portion 206*b* comprises an inner section with internal threads 218. The external threads 220 and internal threads 218 are sized and shaped to fit together. In other words, the first spool portion 206*a* and the second spool portion 206*b* are threadedly coupled. One advantage of this threaded connection is that it forms a secure connection which ensures the tape roll is securely captured by the tape dispenser. In another example, it is possible for the second spool portion 206*b* to have external threads and the first spool portion 206*a* to have matching internal threads. Various other techniques can be used to attach the first spool portion 206*a* to the second spool portion 206*b*, these techniques can include the use of one or more magnets, bolts, or screws.

In the depicted example, the sidewalls 202, 204 are hexagonal. In some examples, the sidewalls can be any suitable shape, for example octagonal, or another polygon. In some examples, the sidewalls have one or more flat edges which has the advantage of helping to prevent the portable tape dispenser from rolling when placed on a surface. In some examples, the sidewalls 202, 204 and spool portions 206*a*, 206*b* are constructed of a rigid material. In some examples the sidewalls are made of plastic. Various other materials can be used including polymeric materials, metals, or a mixture of different materials.

In some examples, one or both of the sidewalls may have a bore (also referred to as a "through hole") 208 in the center of the sidewall. This hole allows the user to insert a finger into the spool while it is being held in the user's hand, thereby allowing the user to have a better hold on the portable tape dispenser and allowing the tape to be dispensed with greater case. In the depicted example, the bore 208 is disposed in the second sidewall 204.

FIG. 13 depicts a perspective view of one end of the portable tape dispenser 200 including the first sidewall 202. The depicted portion includes a recessed portion 201 which can provide a housing for an attached component. In some examples, the recessed portion provides a housing for a mechanism for attaching the portable tape dispenser 200 to a user, such as, for example a clip for attaching the portable tape dispenser 200 to a user's clothing as described below.

FIG. 14 depicts a side view of the end of the portable tape dispenser 200 including a mechanism for attaching the portable tape dispenser to the user. One advantage of such a mechanism is to easily secure the portable tape dispenser to the user to help ensure the tape holder is not dropped or lost. In some examples, this mechanism may be a clip 222 for attaching the portable tape dispenser to a piece of the user's clothing, such as a belt. In some examples, this mechanism may be a loop, clip, or hook. In the depicted example, as shown in FIG. 14, the clip 222 is made of a single, flat piece of material bent over on itself, such as a holster clip. In some examples, the material is metal, in some examples, the mechanism may be constructed of materials such as plastic. In the depicted example, the clip 222 is coupled to the first sidewall 202 by means of two fasteners 224. The fasteners can be permanent or semi-permanent, such as bolts, screws, pins or by other similar means. In some examples, the clip 222 may be coupled to the first side wall by another means, such as glue. In some examples, the clip and the first sidewall may be integrally formed from one continuous piece of material.

Figure 15:
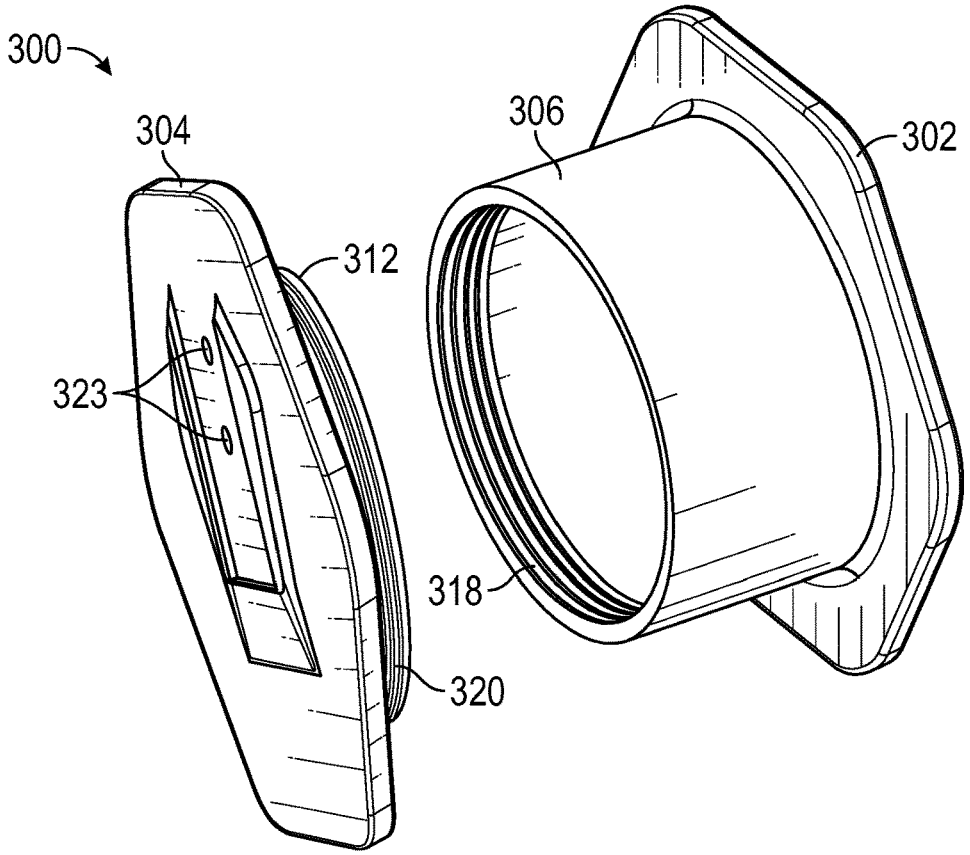
FIG. 15 is an exploded view of a portable tape dispenser according to another example.

FIGS. 15-18 depict a portable tape dispenser (also referred to as a "tape holder") 300 according to another example. As shown in FIG. 15, the portable tape dispenser 300 comprises a first sidewall 302, a second sidewall 304, and a spool 306. The first sidewall 302 and second sidewall 304 may be referred to together as a "pair of sidewalls." The first sidewall 302 and second sidewall 304 can be interchangeable and any features described herein with regards to the first sidewall 302 can be applied to the second sidewall 304, and vice versa. The sidewalls overhang the spool 306 and form rims which are designed to securely capture a tape roll on the spool 306 and prevent it from falling off the spool 306. In the depicted example, the sidewalls are hexagonal. In some examples, the sidewalls can be any suitable shape, for example octagonal, or another polygon. In some examples, the sidewalls are constructed of a rigid material. In some examples the sidewalls comprise plastic. Various other materials can be used including polymeric materials, metals, or a mixture of different materials.

Referring again to FIG. 15, the spool 306 portion is sized to fit within a tape roll. In some examples the outer diameter of the spool 306 is smaller than the inner diameter of the tape roll, leaving clearance between the tape roll and the spool 306 and allowing the tape roll to freely spin around the spool 306 as the tape is dispensed. In some examples the spool 306 is sized to fit with a tight tolerance with the tape roll. In some such instances, friction between the inner surface of the tape roll and the outer surface of the spool 306 may prevent the tape roll from spinning freely around the spool 306.

In the depicted example the spool 306 is cylindrical. In some examples, the cross section of the spool 306 may be of a different shape such as hexagonal, octagonal, or another polygon. In some examples, the sidewalls have one or more flat edges which has the advantage of helping to prevent the portable tape dispenser from rolling when placed on a surface. In some examples, the spool 306 is constructed of a rigid material. In one example, the spool 306 is made of plastic such as polyvinyl chloride (PVC). Acrylonitrile butadiene styrene (ABS) is also a suitable polymeric material. Various other materials can be used including polymeric materials, metals, or a mixture of different materials.

Referring to FIG. 15, the first sidewall 302 is fixedly coupled to a first end of the spool, such as by adhesive, fasteners, etc. In some examples, the first sidewall 302 may be integrally formed with the spool 306 so that the first sidewall 302 and the spool 306 are constructed as a single, unitary component. The second sidewall 304 is removably coupled to the second end of the spool 306 by means of a connector 312. This removable second sidewall 304 allows the tape roll to be installed on the spool 306. Once the tape roll is installed and the second sidewall 304 is attached to the spool 306, the two sidewalls prevent the tape roll from falling off the spool 306.

The second sidewall 304 is fixedly coupled to a connector 312. In some examples, the second sidewall 304 may be integrally formed with the connector 312 so that the second sidewall 304 and the connector 312 are constructed as a single, unitary component. In some examples, the connector 312 is constructed of a rigid material. In one example, the connector 312 is made of plastic such as PVC. Various other materials can be used including polymeric materials (e.g., ABS, nylon, TPU, etc.), metals (e.g., steel, aluminum), wood, or a mixture of different materials.

In one example, the second end of the spool 306 has internal threads (female end) 318, and the connector 312 has external threads (male end) 320. The external threads of the connector 312 and internal threads 318 of the second end of the spool 306 are formed to fit together. One advantage of this threaded connection is that it forms a secure connection between the second sidewall 304 and the spool 306 which ensures the tape roll is securely captured by the tape holder 300. In another example, it is possible for the second end of the spool 306 to have external threads (male end) and the connector 312 to have matching internal threads (female end). Various other techniques can be used to attach the second sidewall 304 to the second end of the spool 306, these techniques include the use of one or more magnets, bolts, screws, frictional fit, and/or other suitable means.

Figure 16:
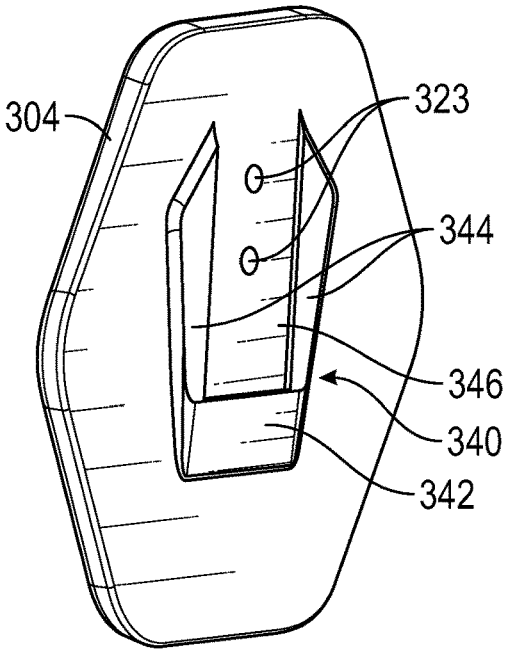
FIG. 16 is a perspective view of a first portion of the portable tape dispenser of FIG. 12 depicting a ridge portion surrounding a recessed portion.

FIG. 16 depicts a perspective view of the second sidewall 304 including a projection 340 which can provide a housing for an attached component. In some examples, the projection 340 comprises a ramp 342 and two side extensions 344. In some examples, there is a recessed portion 346. In some examples the ramp 342 and two side extensions 344 at least partially surround the recessed portion 346. In the depicted example, the ramp 342 and two side extensions 344 extend along three sides of the recessed portion 346. In some examples, the projection 340 provides a housing for a mechanism for attaching the portable tape dispenser 300 to a user, such as, for example a clip for attaching the portable tape dispenser 300 to a user's clothing as described below. In some examples, the recessed portion is recessed relative to the projection 340 and is in the same plane as the rest of the outer surface of the second sidewall 304. The ramp 342 can have the advantage of helping to guide a piece of clothing, such as a belt, into the clip 322 (FIG. 17).

Figure 17:
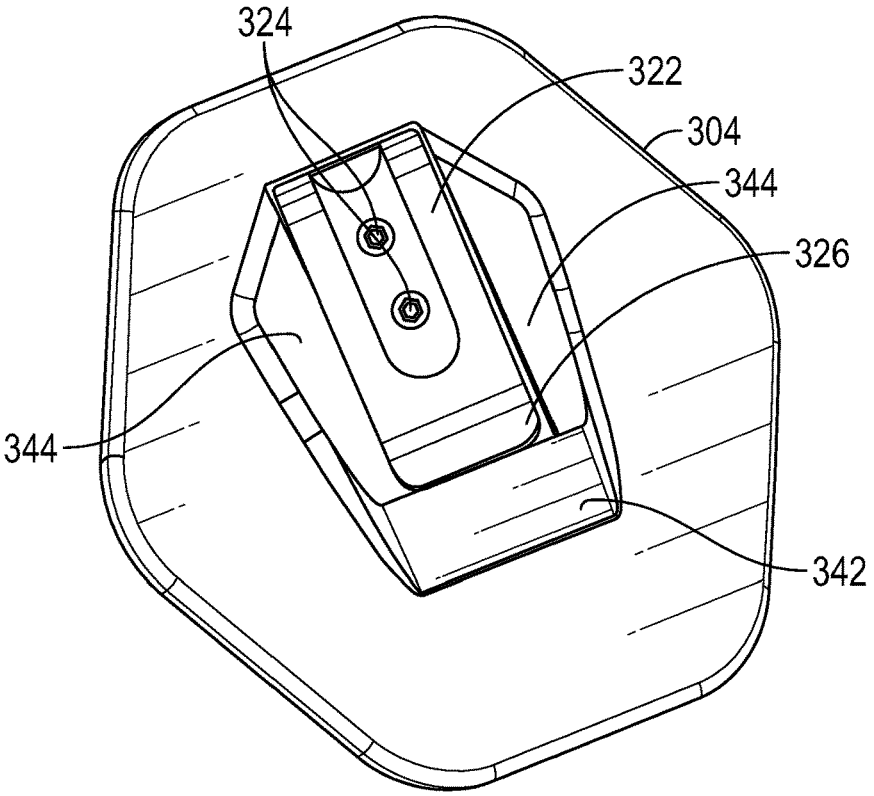
FIG. 17 is a perspective view of the end of the portable tape dispenser of FIG. 16 with a clip installed.
Figure 18:
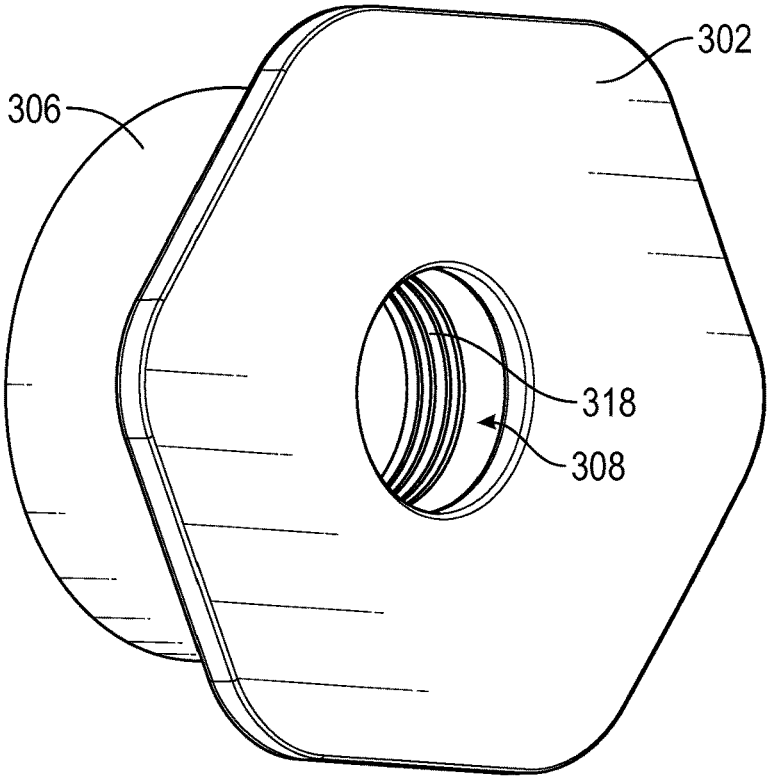
FIG. 18 is a perspective view of a second portion of the portable tape dispenser of FIG. 15.

FIG. 17 depicts a side view of the second sidewall 304 including a mechanism for attaching the portable tape dispenser to the user. One advantage of such a mechanism is to easily secure the portable tape dispenser to the user to help ensure the tape holder is not dropped or lost. In some examples, this mechanism may be a clip for attaching the portable tape dispenser to a piece of the user's clothing, such as a belt. In some instances, this mechanism is a clip 322. In some examples, this mechanism may be a loop, clip, or hook. In the depicted example, as shown in FIG. 17, the clip 322 is made of a single, flat piece of material bent over on itself, such as a holster clip. In the depicted example, the end portion 326 of the clip is bent outward (in other words flared outward) so that it slides more easily over the piece of user's clothing. This outward flared end portion 326, in combination with the ramp 342 helps to direct the piece of user's clothing to be captured by the clip. In some examples, the material is metal, in some examples, the mechanism may be constructed of materials such as plastic. In the depicted example, the clip 322 is coupled to the second sidewall 304 by means of two fasteners 324 which pass through holes 323 (FIG. 16). The fasteners can be permanent or semi-permanent, such as bolts, screws, pins or by other similar means. In some examples, the clip 322 may be coupled to the second side wall 304 by another means, such as glue. In some examples, the clip and the second sidewall may be integrally formed from one continuous piece of material.

In some examples, one or both of the sidewalls may have a bore (also referred to as a "through hole") 308 in the center of the sidewall. This hole allows the user to insert a finger into the spool while it is being held in the user's hand, thereby allowing the user to have a better hold on the portable tape dispenser and allowing the tape to be dispensed with greater ease. In the depicted example, the bore 308 is disposed in the second sidewall 204.

The following is a non-exclusive list of features that may be present. Each of the features can be independent or combined with one or more other features disclosed herein.

Feature 1—Sidewalls are larger in diameter than the spool and form a rim around the spool, this means that the roll of tape is secured in place on the portable tape dispenser and prevents the tape roll from accidentally falling from the tape holder.

Feature 2—Clip or hook for securing the portable tape dispenser to the user's clothing. This assists the user by preventing the tape dispenser from becoming misplaced.

Feature 3—Magnets for attaching the portable tape dispenser to a surface made of a ferromagnetic material.

Feature 4—Removable extension piece for adjusting the length of the spool of the portable tape dispenser to accommodate tape rolls of different widths.

In view of the many possible examples to which the principles of the disclosure may be applied, it should be recognized that the illustrated examples should not be taken as limiting the scope of the disclosure.

The invention claimed is:

1. A tape holder comprising:

a pair of sidewalls comprising a first sidewall and a second sidewall;

a clip coupled to the second sidewall, wherein the second sidewall comprises a projection which houses the clip, and wherein the projection comprises a ramp;

a spool with a first end and a second end, wherein the first end is fixedly coupled to the first sidewall and the second end has internal threads; and a connector wherein the connector has external threads and is fixedly coupled to the second sidewall, wherein the external threads of the connector are sized and shaped to couple with the internal threads of the second end of the spool.

2. The tape holder of claim 1, wherein the first sidewall and the second sidewall are polygonal.

3. The tape holder of claim 1, wherein the first sidewall and the second sidewall are hexagonal.

4. The tape holder of claim 1, wherein the projection further comprises two side extensions, wherein the ramp and the two side extensions at least partially surround a recessed portion.

5. The tape holder of claim 1, wherein one or more of the sidewalls of the pair of sidewalls has a through hole.

6. The tape holder of claim 1, further comprising an extension piece, wherein the spool has a spool diameter and the extension piece has an extension piece diameter and the spool diameter and the extension piece diameter are equal, and the extension piece has a first end and a second end, wherein the first end of the extension piece has external threads and the second end of the extension piece has internal threads, and wherein the external threads of the first end of the extension piece are formed so as to couple with the internal threads of the second end of the spool, and wherein the internal threads of the second end of the extension piece are formed so as to couple with the external threads of the connector.

7. The tape holder of claim 1, wherein one of the sidewalls of the pair of sidewalls comprises one or more embedded magnets.

8. The tape holder of claim 1, wherein the spool further comprises projections spaced around an outer surface of the spool.

9. A tape holder comprising:

a first sidewall;

a second sidewall;

a clip coupled to the first sidewall, wherein the first sidewall comprises a projection which houses the clip, and wherein the projection comprises a ramp; and a spool comprising a spool first portion and a spool second portion, wherein the spool first portion is coupled to the first sidewall and the spool second portion is coupled to the second sidewall, wherein the spool first portion is removably coupled to the spool second portion.

10. The tape holder of claim 9, wherein the first sidewall and the second sidewall are polygonal.

11. The tape holder of claim 9, wherein the first sidewall and the second sidewall are hexagonal.

12. The tape holder of claim 9, wherein the spool first portion is threadedly coupled to the spool second portion.

13. The tape holder of claim 9, further comprising a through hole disposed in the second sidewall.

14. The tape holder of claim 9, further comprising a recessed portion in the first sidewall, wherein the recessed portion provides a housing for the clip.

15. A tape holder comprising:

a pair of sidewalls comprising a first sidewall and a second sidewall, wherein the first and second sidewalls are polygonal;

a clip coupled to the second sidewall, wherein the clip is housed by a projection comprising a ramp;

a spool with a first end and a second end, wherein the first end is fixedly coupled to the first sidewall and the second end has internal threads; and a connector, wherein the connector has external threads and is fixedly coupled to the second sidewall, and wherein the external threads of the connector are sized and shaped to couple with the internal threads of the second end of the spool.

16. The tape holder of claim 15, further comprising a through hole disposed in the first sidewall.

* * * * *